US009392375B2

(12) United States Patent
Hirayama et al.

(10) Patent No.: US 9,392,375 B2
(45) Date of Patent: Jul. 12, 2016

(54) ACOUSTIC GENERATOR, ACOUSTIC GENERATION DEVICE, AND ELECTRONIC DEVICE

(71) Applicant: Kyocera Corporation, Kyoto-shi (JP)

(72) Inventors: Takeshi Hirayama, Kirishima (JP); Shuichi Fukuoka, Kirishima (JP); Noriyuki Kushima, Kirishima (JP); Hiroshi Ninomiya, Kirishima (JP)

(73) Assignee: Kyocera Corporation, Kyoto-shi (JP)

( * ) Notice: Subject to any disclaimer, the term of this patent is extended or adjusted under 35 U.S.C. 154(b) by 0 days.

(21) Appl. No.: 14/125,559

(22) PCT Filed: Jun. 28, 2013

(86) PCT No.: PCT/JP2013/067926
§ 371 (c)(1),
(2) Date: Dec. 11, 2013

(87) PCT Pub. No.: WO2014/024600
PCT Pub. Date: Feb. 13, 2014

(65) Prior Publication Data

US 2014/0233768 A1 Aug. 21, 2014

(30) Foreign Application Priority Data

Aug. 10, 2012 (JP) ..... 2012-179047

(51) Int. Cl.
*H04R 17/00* (2006.01)
*G10K 11/00* (2006.01)
(Continued)

(52) U.S. Cl.
CPC ..... *H04R 17/005* (2013.01); *G10K 9/125* (2013.01); *G10K 11/002* (2013.01); *H04R 1/00* (2013.01); *H04R 17/00* (2013.01); *H04R 1/02* (2013.01)

(58) Field of Classification Search
CPC .. H04R 17/00; H04R 2499/11; H04R 17/005; H04R 31/00
See application file for complete search history.

(56) References Cited

U.S. PATENT DOCUMENTS 2,405,187 A * 8/1946 Benioff ..... 367/157
2,413,462 A * 12/1946 Massa ..... 367/157
(Continued)

FOREIGN PATENT DOCUMENTS

DE WO 9311527 A1 * 6/1993 ..... G10K 9/122
DE 10 2010 018 993 A1 11/2011
(Continued)

OTHER PUBLICATIONS

Japanese International Search Report, PCT/JP2013/067926, Sep. 3, 2013, 1 pp.
(Continued)

*Primary Examiner* — Davetta W Goins
*Assistant Examiner* — Oyesola C Ojo
(74) *Attorney, Agent, or Firm* — Volpe and Koenig, P.C.

(57) ABSTRACT

The problem is to reduce variations of sound pressure in the sound pressure frequency characteristics. To solve the problem, an acoustic generator includes a film that is a supporting plate; a frame member that is provided on the outer circumference of the film; a piezoelectric element that is provided on the film within a frame of the frame member; and a resin layer that is provided on the film within the frame of the frame member, and the resin layer including an air bubble. By the air bubble, a decrease in the sound pressure is prevented, peaks and dips in the frequency characteristics of sound pressure are reduced, and high-quality sounds are generated.

6 Claims, 9 Drawing Sheets

(51) Int. Cl.

| | |
|---|---|
| ***H04R 1/00*** | (2006.01) |
| ***G10K 9/125*** | (2006.01) |
| *H04R 1/02* | (2006.01) |

(56) References Cited

U.S. PATENT DOCUMENTS

| | | | | |
|---|---|---|---|---|
| 2,414,489 | A * | 1/1947 | Shomer | 381/190 |
| 2,416,978 | A * | 3/1947 | Burgess | 310/300 |
| 6,453,050 | B1 * | 9/2002 | Ogura et al. | 381/190 |
| 2005/0174016 | A1 * | 8/2005 | Chisaka et al. | 310/358 |
| 2007/0019134 | A1 * | 1/2007 | Park et al. | 349/96 |
| 2009/0076179 | A1 * | 3/2009 | Sugawara | B32B 5/18 521/81 |
| 2010/0038998 | A1 * | 2/2010 | Onishi | H04R 17/00 310/334 |
| 2013/0094681 | A1 | 4/2013 | Fukuoka et al. | |

FOREIGN PATENT DOCUMENTS

| | | | |
|---|---|---|---|
| DE | 10 2010 029 283 | A1 | 12/2011 |
| JP | S57-128300 | U | 8/1982 |
| JP | 2006287830 | A | 10/2006 |
| JP | 2010177867 | A | 8/2010 |
| JP | 2012110018 | A | 6/2012 |
| WO | 93/11527 | A1 | 6/1993 |
| WO | 2011/147604 | A1 | 12/2011 |

OTHER PUBLICATIONS

Japanese Office Action with English concise explanation, Japanese Patent Application No. 2014-153007, Jun. 29, 2015, 6 pgs.

Extended European Search Report, European Patent Application No. 13828515.0, Oct. 8, 2015, 6 pgs.

* cited by examiner

ACOUSTIC GENERATOR, ACOUSTIC GENERATION DEVICE, AND ELECTRONIC DEVICE

FIELD OF INVENTION

The present invention relates to an acoustic generator, an acoustic generation device, and an electronic device.

BACKGROUND

Conventional piezoelectric speakers are known as small-sized and low-current drive acoustic equipment that uses a piezoelectric body for an electro-acoustic conversion element, and they are used as acoustic generation devices that are installed in small-sized electronic devices, for example, mobile computing devices, or the like.

Generally, acoustic generators that use a piezoelectric body for an electro-acoustic conversion element have a structure such that an electrode is formed on a piezoelectric body by using a thin silver film, or the like, and a piezoelectric element is attached to a metallic vibration plate. In this kind of acoustic generators, an alternate-current voltage is applied to the piezoelectric element so that the form distortion occurs in the piezoelectric element, and the form distortion of the piezoelectric element is transmitted to the metallic vibration plate for vibration, whereby sounds are generated.

However, in the acoustic generators that have a structure such that the piezoelectric element is attached to the metallic vibration plate, the piezoelectric element that expands for vibration is constrained by the metallic plate whose surface area does not change so that surface-area flexion vibration occurs; therefore, acoustic conversion efficiency is low, and it is difficult to obtain the sound pressure characteristics in which the resonance frequency is low while it has a compact size.

For these problems, the applicant has proposed an acoustic generator that uses a resin film as a vibration plate instead of a metallic vibration plate (for example, see Patent Literature 1).

In this acoustic generator, a bimorph lamination-type piezoelectric element is sandwiched between a pair of resin films in its thickness direction, and the resin films are secured to a frame member in a tensioned state. Thus, acoustic conversion efficiency can be improved, and a high sound pressure can be generated.

CITATION LIST

Patent Literature

Patent Literature 1: Japanese Patent Application Laid-open No. 2010-177867

SUMMARY

Technical Problem

However, in the above-described acoustic generators, there are variations of the sound pressure in the sound pressure frequency characteristics; therefore, in order to further improve the sound quality, it is necessary to reduce the variations of the sound pressure.

An acoustic generator according to an aspect of embodiments includes a film; a frame member that is provided on the outer circumference of the film; a piezoelectric element that is provided on the film within a frame of the frame member; and a resin layer that is provided on the film within the frame of the frame member, and the resin layer including an air bubble.

DETAILED DESCRIPTION OF THE PREFERRED EMBODIMENTS

A detailed explanation is given below, with reference to the drawings, of an embodiment of an acoustic generator, an acoustic generation device, and an electronic device according to the present invention. The present invention is not limited to the embodiment. Each of the configurations described below as the embodiment may be combined as appropriate to the extent that there are no contradictions of the shape or size of each member included in the acoustic generator.

(1) First Configuration

Structure of Acoustic Generator

Figure 1A:
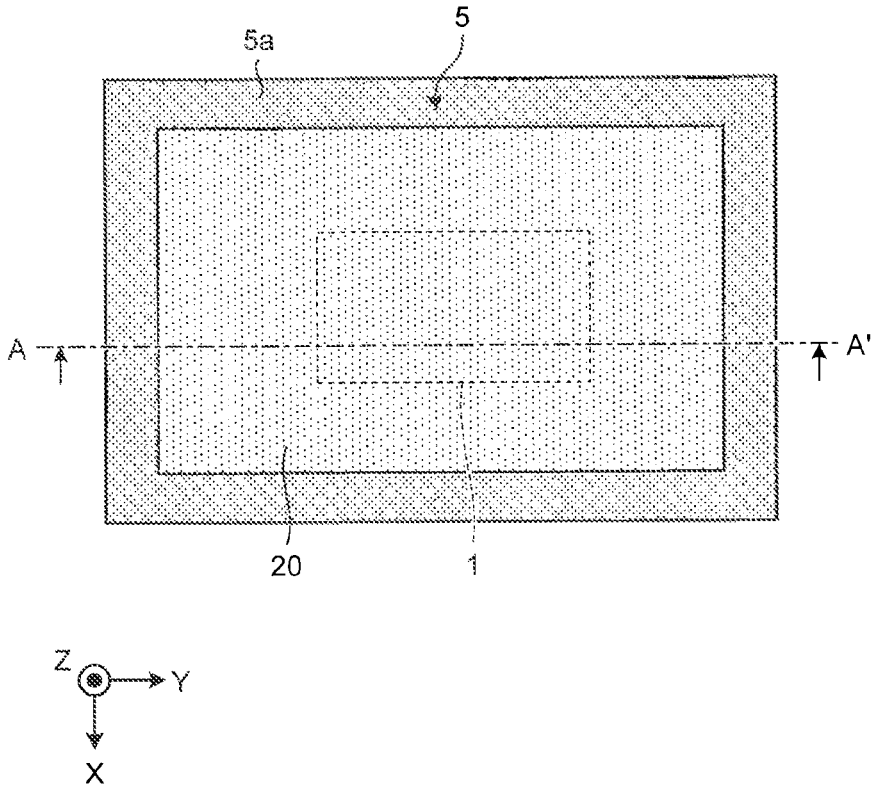
FIG. 1A is a plan view that illustrates an acoustic generator according to a first configuration.
Figure 1B:
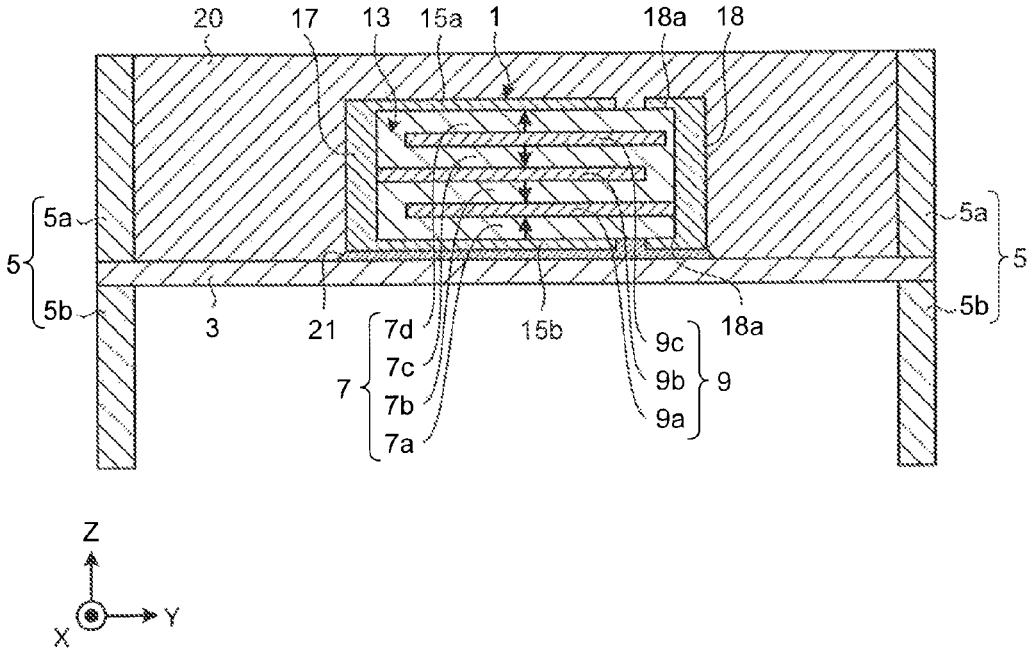
FIG. 1B is a cross-sectional view that illustrates the acoustic generator according to the first configuration.

First, an explanation is given, with reference to FIGS. 1A and 1B, of an acoustic generator according to a first configuration of the present invention. FIG. 1A is a plan view that illustrates an acoustic generator according to the first configuration, and FIG. 1B is a cross-sectional view taken along the line A-A' of FIG. 1A. In FIG. 1A, the dashed line indicates the position of a piezoelectric element 1 that is covered by a resin layer 20 and cannot be seen from the +Z direction. Furthermore, in order to facilitate understanding, FIG. 1B illustrates the lamination-type piezoelectric element 1 in its thickness direction (the Z-axis direction) in an enlarged manner. Moreover, the illustration of air bubbles 8 in the resin layer 20 is omitted from FIGS. 1A and 1B.

The acoustic generator according to the first configuration illustrated in FIGS. 1A and 1B includes a film 3, a frame member 5 that is provided on the outer circumference of the film 3, the piezoelectric element 1 that is provided on the film 3 within the frame of the frame member 5, and the resin layer 20 that is provided on the film 3 within the frame of the frame member 5.

The frame member 5 includes a pair of frame members 5*a*, 5*b*, the outer circumference of the film 3 is sandwiched between the frame members 5*a*, 5*b* in a tensioned state so that the film 3 is secured to the frame member 5 as illustrated in FIG. 1B, and the lamination-type piezoelectric element 1 is located on the upper surface of the film 3.

Furthermore, the piezoelectric element 1 is formed like a plate and has the top and bottom principal surfaces formed into a square, rectangle, or polygon. The piezoelectric element 1 includes a laminate 13 in which four piezoelectric layers 7 (7*a*, 7*b*, 7*c*, 7*d*) and three internal electrode layers 9 (9*a*, 9*b*, 9*c*) are alternately laminated; surface electrode layers 15*a*, 15*b* that are formed on the top and bottom surfaces of the laminate 13; and first to third external electrodes that are provided at the ends of the laminate 13 in a longitudinal direction (the Y-axis direction).

A first external electrode 17 is located at the end of the laminate 13 in the −Y direction and is connected to the surface electrode layers 15*a*, 15*b* and the internal electrode layer 9*b*. A second external electrode 18 and a third external electrode (not illustrated) are located at the end of the laminate 13 in the +Y direction with a space interposed therebetween in the X-axis direction. The second external electrode 18 is connected to the internal electrode layer 9*a*, and the third external electrode (not illustrated) is connected to the internal electrode layer 9*c*. A configuration is such that the piezoelectric layers 7 are polarized in the directions indicated by the arrows in FIG. 1B and a voltage is applied to the first external electrode 17, the second external electrode 18, and the third external electrode such that the piezoelectric layers 7*c*, 7*d* expand when the piezoelectric layers 7*a*, 7*b* contract and such that the piezoelectric layers 7*c*, 7*d* contract when the piezoelectric layers 7*a*, 7*b* expand. As described above, the piezoelectric element 1 is a bimorph piezoelectric element and, when an electric signal is input, it inflects and vibrates in the Z-axis direction so that the amplitude changes in the Y-axis direction.

The top and bottom ends of the second external electrode 18 extend to the upper and lower surfaces of the laminate 13 so that turnover external electrodes 18*a* are formed, and the turnover external electrodes 18*a* extend with a predetermined distance interposed with the surface electrode layers 15*a*, 15*b* formed on the surfaces of the laminate 13 so that the turnover external electrodes 18*a* are not in contact with the surface electrode layers 15*a*, 15*b*. Similarly, the top and bottom ends of the third external electrode (not illustrated) extend to the upper and lower surfaces of the laminate 13 so that turnover external electrodes (not illustrated) are formed, and the turnover external electrodes (not illustrated) extend with a predetermined distance interposed with the surface electrode layers 15*a*, 15*b* formed on the surfaces of the laminate 13 so that the turnover external electrodes are not in contact with the surface electrode layers 15*a*, 15*b*.

The above-described four piezoelectric layers 7 and the above-described three internal electrode layers 9 are simultaneously formed by being burned in a laminated state, and the surface electrode layers 15*a*, 15*b* are formed by being burned after the laminate 13 is fabricated and conductive paste is applied thereto.

Furthermore, the principal surface of the piezoelectric element 1 on the side of the film 3 is bonded to the film 3 via an adhesive layer 21. The thickness of the adhesive layer 21 is preferably equal to or less than 20 μm and, more preferably, equal to or less than 10 μm. If the thickness of the adhesive layer 21 is equal to or less than 20 μm, the vibration of the laminate 13 is easily transmitted to the film 3.

Known adhesives, such as an epoxy based resin, silicon resin, or polyester based resin, may be used to form the adhesive layer 21. Resin used as an adhesive may be hardened by using any method, such as heat hardening, light hardening, or anaerobic hardening.

Furthermore, in the acoustic generator according to the first configuration, the resin layer 20 is formed by filling the inside of the frame member 5*a* with resin so that the piezoelectric element 1 is buried.

An epoxy based resin, acrylic based resin, silicon based resin or rubber, or the like, may be used for the resin layer 20. Furthermore, it is preferable that the resin layer 20 is applied in a state such that the piezoelectric element 1 is completely covered thereby in terms of prevention of peaks and dips; however, the piezoelectric element 1 may not be completely covered. Moreover, an area of the film 3 that is not covered by the piezoelectric element 1 is also covered by the resin layer 20. The resin layer 20 does not necessarily need to cover the overall film 3 but, in some cases, the resin layer 20 may be provided to cover part of the film 3. The thickness of the resin layer 20 is set to, for example, about 0.1 mm to 1 mm.

As described above, with the provision of the resin layer 20 in the acoustic generator according to the first configuration, it is possible to appropriately damp resonance phenomena. Because of the damping effect, resonance phenomena can be reduced, and peaks and dips in the frequency characteristics of sound pressure that occur due to resonance phenomena can be reduced. As a result, the frequency characteristics of sound pressure can be flat.

Existing piezoceramics, such as lead zirconate (PZ), lead zirconate titanate (PZT), a Bi-layered compound, a lead-free piezoelectric material such as a tungsten bronze structure compound, or the like, may be used for the piezoelectric layer 7. The thickness of the piezoelectric layer 7 is set to 10 to 100 μm in terms of a low-voltage drive.

The internal electrode layers 9 may be formed by using various existing conductive materials; however, it is preferable that it contains a metallic component that includes silver and palladium and a material component that is included in the piezoelectric layer 7. Furthermore, the internal electrode layer 9 contains a ceramic component that is included in the piezoelectric layer 7 so that it is possible to reduce the stress that is caused due to the difference in the thermal expansion of the piezoelectric layer 7 and the internal electrode layer 9. The internal electrode layer 9 may not contain a metallic component that includes silver and palladium or may not contain a material component that is included in the piezoelectric layer 7.

The surface electrode layers 15*a*, 15*b* and the first to third external electrodes may be formed by using various existing conductive materials; however, it is preferable that they contains a metallic component that includes silver and a glass component. If they contain a glass component as described above, it is possible to obtain a strong adhesive force among the piezoelectric layer 7, the internal electrode layer 9, the surface electrode layers 15*a*, 15*b*, and the first to third external electrodes.

The frame member 5 is rectangular and, as illustrated in FIG. 1B, the two rectangular frame members 5*a*, 5*b* are bonded to each other to form it. The outer circumference of the film 3 is sandwiched between the frame member 5*a* and the frame member 5*b* and is fixed in a state where tension is applied to the film 3. The thickness of the frame members 5*a*, 5*b* is, for example, about 100 to 1000 μm, and the length of a side of the inner frame is, for example, about 20 mm to 200 mm. The material of the frame members 5*a*, 5*b* may be less likely to be deformed compared to the resin layer 20, and, for example, a hard resin, plastic, engineering plastic, ceramic, or the like, may be used, and stainless, for example, may be preferably used. The material, thickness, and the like, of the frame members 5*a*, 5*b* are not particularly limited. Furthermore, the shape of the frame member 5 is not limited to a rectangle and, for example, the part or whole of the inner circumference or outer circumference may be oval or the inner circumference or outer circumference may be diamond-shaped.

The outer circumference of the film 3 is sandwiched between the frame members 5*a*, 5*b* so that the film 3 is fixed to the frame members 5*a*, 5*b* in a state where tension is applied to the film 3 in a planar direction, whereby the film 3 serves as a vibration plate. The thickness of the film 3 is, for example, 10 to 200 μm, and the film 3 includes a resin, such as polyethylene, polyimide, polypropylene, or polystyrene, or paper that includes pulp, fibers, or the like. The use of these materials can reduce peaks and dips.

[Air Bubbles in Resin Layer]

Next, an explanation is given of air bubbles in the resin layer 20 included in the acoustic generator according to the first configuration of the present embodiment. As illustrated in FIGS. 2 to 5, the resin layer 20 according to the first configuration includes air bubbles 8. The size of the air bubble 8 (the largest value of the distance between two points that are located on a surface) is preferably, for example, about 20 to 150 μm. The shape of the air bubble 8 is typically a spherical shape; however, it may be other shapes. The percentage of the air bubbles 8 that exist in the resin layer 20 will be explained in detail later with reference to FIGS. 8 to 11.

With the provision of the air bubbles 8 in the resin layer 20, as described above, it is possible to improve the quality of sound generated by the acoustic generator. Although the reason why the above advantage is produced is not clearly identified, it can be supposed as described below. If the air bubbles (void) exist in the resin layer 20, the stress occurs due to the vibration of the vibrating body that includes the film 3 and the resin layer 20 that are integrated with the piezoelectric element 1, and the stress concentrates in the vicinity of the air bubble 8. As a result, the local strain in the vicinity of the air bubble 8 becomes large, and part of the vibration energy is absorbed by the air bubble 8; thus, the Q factor of the resonance in the vibration system is decreased. Thus, it is possible to reduce peaks and dips, which occur due to the resonance, in the frequency characteristics of sound pressure. Thus, the frequency characteristics of sound pressure become flatter, whereby the quality of sound generated by the acoustic generator is improved. Furthermore, because the sound quality can be improved without increasing the thickness of the resin layer 20, it is possible to prevent a decrease in the overall sound pressure. Moreover, as the air bubbles 8 included in the resin layer 20 can reduce peaks and dips that are caused due to all the resonant modes, it is possible to improve the sound quality in the entire frequency range in which the sound pressure can be obtained due to bending, deflection, and vibration of the vibrating body.

As described above, in the acoustic generator according to the first configuration, variations of the sound pressure in the sound pressure frequency characteristics can be reduced, and the sound quality can be improved. Next, an explanation is given, with reference to FIGS. 2 to 5, of a method of effectively providing the air bubbles 8 in the resin layer 20.

Figure 2:
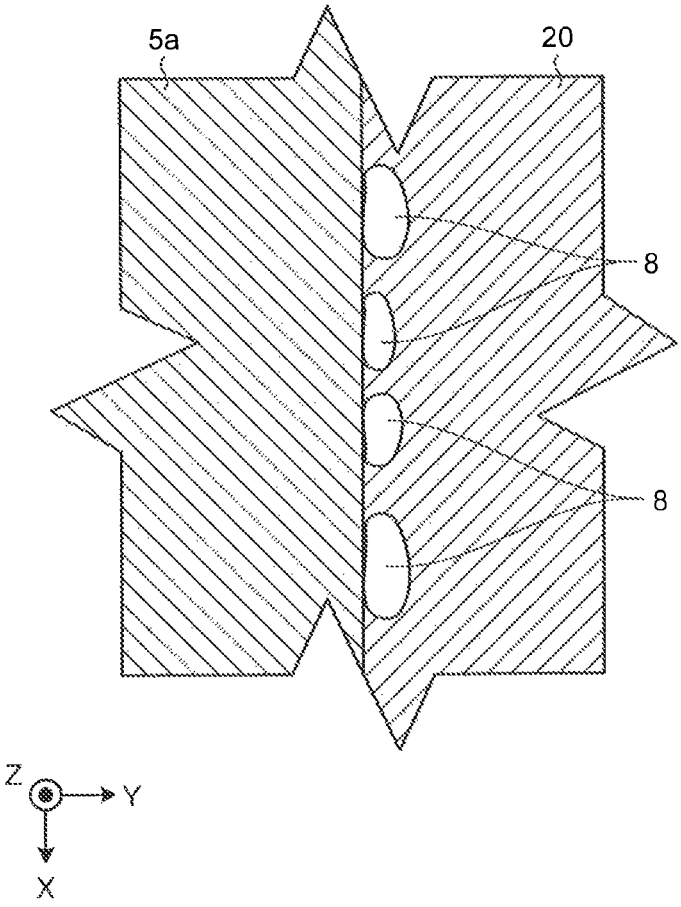
FIG. 2 is a partial cross-sectional view for explaining a first example of a method of effectively providing air bubbles in a resin layer of the acoustic generator according to the first configuration.

FIG. 2 is a partial cross-sectional view for explaining a first example of the method of effectively providing the air bubbles 8 in the resin layer 20 of the acoustic generator according to the first configuration illustrated in FIGS. 1A, 1B, and it illustrates part of the frame member 5*a* and the resin layer 20 in the vicinity of the boundary therebetween in an enlarged manner.

In the example illustrated in FIG. 2, the air bubble 8 in the resin layer 20 is provided such that at least part of the air bubble 8 abuts the boundary between the frame member 5*a* and the resin layer 20. The boundary between the frame member 5*a* and the resin layer 20 is an area where the stiffness changes in the acoustic generator; therefore, when the acoustic generator vibrates, the stress concentrates at the area. As the air bubble 8 is provided at the area where the stress concentrates, the air bubble 8 can absorb the vibration energy more effectively, whereby the quality of sound generated by the acoustic generator can be effectively improved. As described above, in the example illustrated in FIG. 2, the air bubble 8 in the resin layer 20 is provided such that at least part of the air bubble 8 abuts the area where the stiffness changes in the acoustic generator; thus, it is possible to effectively improve the quality of sound generated by the acoustic generator.

Furthermore, in the example illustrated in FIG. 2, it is preferable that the air bubble 8 provided so as to abut the boundary between the frame member 5*a* and the resin layer 20 does not have a complete spherical shape but has a shape that extends in a direction along which it abuts the boundary between the frame member 5*a* and the resin layer 20 (a direction parallel to the boundary between the frame member 5*a* and the resin layer 20). Specifically, it is preferable that, when seen in a planar view, the air bubble 8 provided so as to abut the boundary between the frame member 5*a* and the resin layer 20 has a shape that elongates in a direction along the boundary between the frame member 5*a* and the resin layer 20 (a shape such that the length in a direction along the boundary between the frame member 5*a* and the resin layer 20 is longer than the length in a direction perpendicular to the boundary between the frame member 5*a* and the resin layer 2). Hence, the area of the air bubble 8 that abuts the boundary between the frame member 5*a* and the resin layer 20 can be larger; thus, the air bubble 8 can absorb the vibration energy more effectively, and the quality of sound generated by the acoustic generator can be effectively improved. In this specification, the acoustic generator is seen from the thickness direction (the Z-axis direction) of the resin layer 20 in order to see it in a planar view.

Figure 3:
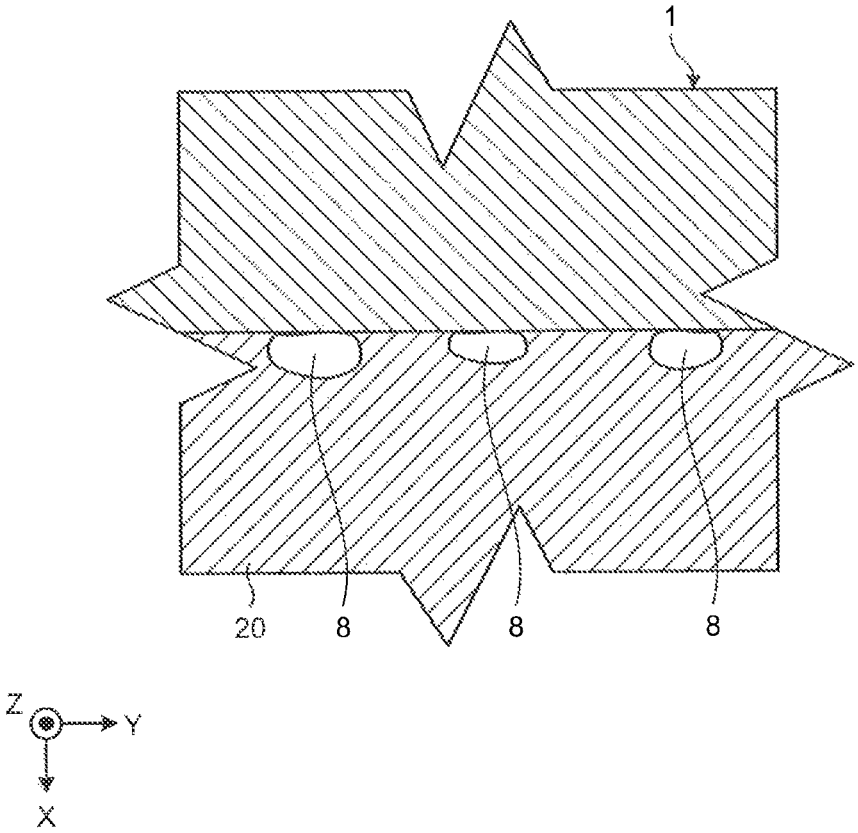
FIG. 3 is a partial cross-sectional view for explaining a second example of the method of effectively providing the air bubbles in the resin layer of the acoustic generator according to the first configuration.

FIG. 3 is a partial cross-sectional view for explaining a second example of the method of effectively providing the air bubbles 8 in the resin layer 20 of the acoustic generator according to the first configuration illustrated in FIGS. 1A, 1B, and it illustrates part of the piezoelectric element 1 and the resin layer 20 in the vicinity of the boundary therebetween in an enlarged manner.

In the example illustrated in FIG. 3, the air bubble 8 in the resin layer 20 is provided such that at least part of the air bubble 8 abuts the boundary between the piezoelectric element 1 and the resin layer 20. The boundary between the piezoelectric element 1 and the resin layer 20 is an area where the stiffness changes in the acoustic generator. Therefore, if the air bubble 8 in the resin layer 20 is provided such that at least part of the air bubble 8 abuts the boundary between the piezoelectric element 1 and the resin layer 20, it is possible to effectively improve the quality of sound generated by the acoustic generator in the same manner as in the above-described first example.

Furthermore, in the example illustrated in FIG. 3, it is preferable that the air bubble 8 provided so as to abut the boundary between the piezoelectric element 1 and the resin layer 20 does not have a complete spherical shape but has a shape that extends in a direction along which it abuts the boundary between the piezoelectric element 1 and the resin layer 20. Specifically, it is preferable that, when seen in a planar view, the air bubble 8 provided so as to abut the boundary between the piezoelectric element 1 and the resin layer 20 has a shape that elongates in a direction along the boundary between the piezoelectric element 1 and the resin layer 20 (a shape such that the length in a direction along the boundary between the piezoelectric element 1 and the resin layer 20 is longer than the length in a direction perpendicular to the boundary between the piezoelectric element 1 and the resin layer 20). Hence, the area of the air bubble 8 that abuts the boundary between the piezoelectric element 1 and the resin layer 20 can be larger; thus, the air bubble 8 can absorb the vibration energy more effectively, and the quality of sound generated by the acoustic generator can be effectively improved.

Figure 4:
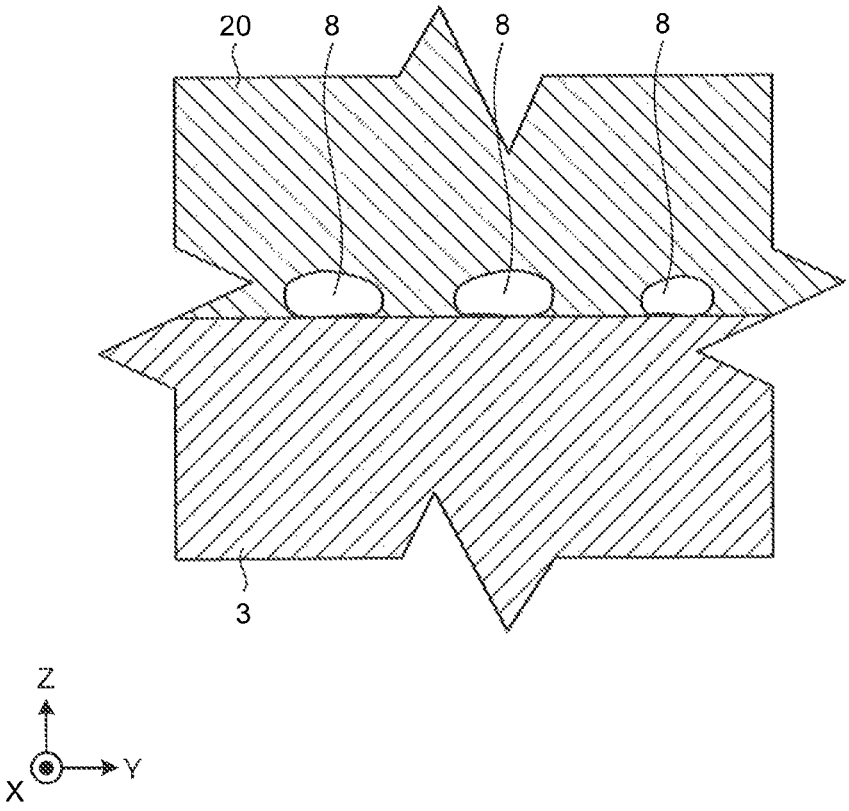
FIG. 4 is a partial cross-sectional view for explaining a third example of the method of effectively providing the air bubbles in the resin layer of the acoustic generator according to the first configuration.

FIG. 4 is a partial cross-sectional view for explaining a third example of the method of effectively providing the air bubbles 8 in the resin layer 20 of the acoustic generator according to the first configuration illustrated in FIGS. 1A, 1B, and it illustrates part of the film 3 and the resin layer 20 in the vicinity of the boundary therebetween in an enlarged manner.

In the example illustrated in FIG. 4, the air bubble 8 in the resin layer 20 is provided such that at least part of the air bubble 8 abuts the boundary between the film 3 and the resin layer 20. The boundary between the film 3 and the resin layer 20 is an area where the stiffness changes in the acoustic generator. As the air bubble 8 in the resin layer 20 is provided such that at least part of the air bubble 8 abuts the boundary between the film 3 and the resin layer 20, the quality of sound generated by the acoustic generator can be effectively improved in the same manner as in the above-described first example and second example.

Furthermore, in the example illustrated in FIG. 4, it is preferable that the air bubble 8 provided so as to abut the boundary between the film 3 and the resin layer 20 does not have a complete spherical shape but has a shape that extends in a direction along which it abuts the boundary between the film 3 and the resin layer 20 (a direction parallel to the boundary between the film 3 and the resin layer 20). Specifically, it is preferable that, when seen from a direction parallel to the boundary between the film 3 and the resin layer 20, the air bubble 8 provided so as to abut the boundary between the film 3 and the resin layer 20 has a shape that elongates in a direction along the boundary between the film 3 and the resin layer 20 (a shape such that the length in a direction along the boundary between the film 3 and the resin layer 20 is longer than the length in a direction perpendicular to the boundary between the film 3 and the resin layer 2). Hence, the area of the air bubble 8 that abuts the boundary between the film 3 and the resin layer 20 can be larger; thus, the air bubble 8 can absorb the vibration energy more effectively, and the quality of sound generated by the acoustic generator can be effectively improved.

Figure 5:
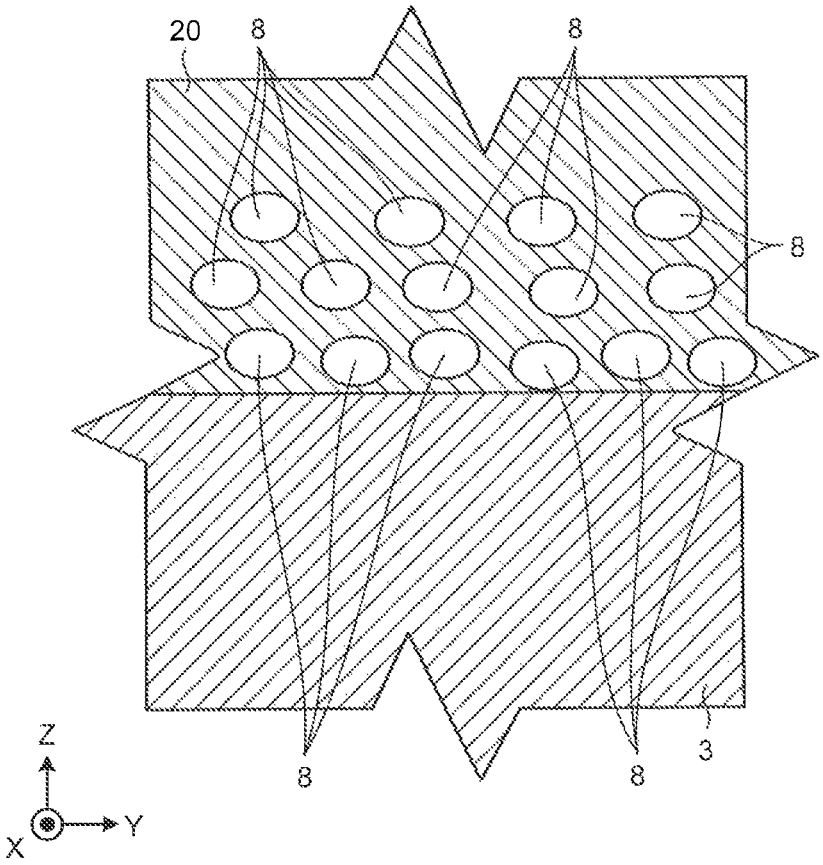
FIG. 5 is a partial cross-sectional view for explaining a fourth example of the method of effectively providing the air bubbles in the resin layer of the acoustic generator according to the first configuration.

FIG. 5 is a partial cross-sectional view for explaining a fourth example of the method of effectively providing the air bubbles 8 in the resin layer 20 of the acoustic generator according to the first configuration illustrated in FIGS. 1A, 1B, and it illustrates part of the film 3 and the resin layer 20 in the vicinity of the boundary therebetween in an enlarged manner.

In the example illustrated in FIG. 5, the air bubbles 8 of the resin layer 20 are provided such that they are unevenly distributed in the vicinity of the boundary between the film 3 and the resin layer 20 with respect to the thickness direction of the resin layer 20. Furthermore, the air bubbles 8 of the resin layer 20 are provided such that a larger number of the air bubbles 8 are distributed as they are located closer to the surface boundary between the film 3 and the resin layer 20. Specifically, the air bubbles 8 are provided such that the number of the air bubbles 8 is increased as they are located closer to the surface boundary between the film 3 and the resin layer 20. As the air bubbles 8 are provided as described above, the quality of sound generated by the acoustic generator can be effectively improved. The reason why the above advantage is produced can be supposed as described below. Specifically, the boundary between the film 3 and the resin layer 20 is an area where the stiffness changes in the acoustic generator; therefore, when the acoustic generator vibrates, distortion (deformation) of an area of the resin layer 20 in the vicinity of the boundary with the film 3 is larger than that of an area of the resin layer 20 located farther away from the boundary with the film 3. Therefore, the vibration energy can be effectively absorbed by the air bubbles 8 if they are provided so as to be unevenly distributed in the vicinity of the boundary between the film 3 and the resin layer 20 or they are provided such that the number of the air bubbles 8 is increased as they are located closer to the surface boundary between the film 3 and the resin layer 20. Thus, the Q factor of the resonance in the vibration system can be decreased, and the peaks and dips, which occur due to the resonance, in the frequency characteristics of sound pressure can be reduced, whereby flatter sound pressure frequency characteristics can be obtained.

[Process of Manufacture]

An explanation is given of an example of a method for manufacturing the acoustic generator according to the present invention.

First, the piezoelectric element 1 is prepared. Powders of a piezoelectric material are first mixed with binder, dispersant, plasticizer, and solvent and are then kneaded so that slurry is produced. Any piezoelectric materials, lead-based or lead-free, may be used.

Next, the above slurry is formed into a sheet-like shape so that a green sheet is obtained. An internal electrode paste is printed on the green sheet so that an internal electrode pattern is formed, three green sheets on which an electrode pattern is formed are laminated, and a green sheet on which an electrode pattern is not printed is laminated on them, whereby a compact laminate is fabricated.

Next, the above-described compact laminate is degreased, burned, and cut into a predetermined size so that the laminate 13 is obtained. The outer circumference of the laminate 13 is processed as needed, paste for the surface electrode layers 15*a*, 15*b* is printed on both principal surfaces of the laminate 13 with respect to the laminate direction, the first to third external electrodes are printed on both end surfaces of the laminate 13 with respect to the longitudinal direction (the Y-axis direction), and then the electrodes are burned at a predetermined temperature. Thus, the piezoelectric element 1 illustrated in FIGS. 1A and 1B can be obtained.

Next, in order to apply piezoelectricity to the piezoelectric element 1, a direct-current voltage is applied through the first to third external electrodes so that the piezoelectric layers 7 of the piezoelectric element 1 are polarized. A DC voltage is applied such that they are polarized in the directions indicated by the arrows in FIG. 1B.

Next, the film 3 that is a supporting member is prepared, and the outer circumference of the film 3 is sandwiched between the frame members 5*a*, 5*b* so that the film 3 is fixed in a state where tension is applied thereto. Afterward, an adhesive is applied to the film 3, the surface electrode layer 15*b* of the piezoelectric element 1 is pressed against the film 3, and then the adhesive is irradiated with heat or ultraviolet so that it is hardened. Uncured resin is poured into the inside of the frame member 5*a*, the air bubbles 8 are formed at predetermined locations, and then the resin is cured so that the resin layer 20 is formed. Thus, the acoustic generator according to the first configuration can be obtained.

The air bubbles 8 may be formed in the resin layer 20 by using various methods. A possible method to be used is that, for example, hollow resin spheres are provided at desired locations and then uncured resin is poured into the inside of the frame member 5*a*. Another possible method to be used is that hollow resin spheres (cured or partially cured) are mixed in with uncured resin for application. In this case, for example, after resin that includes hollow resin spheres is applied to a desired area and then dried, resin that does not include hollow resin spheres is poured and then cured, whereby it is possible to selectively locate the air bubbles 8 at desired locations in the resin layer 20. Furthermore, multiple uncured resins are prepared in which the number of hollow resin spheres mixed therein (the degree of density of resin spheres in the resin) is different, they are applied to the film and are dried in order, starting with the one that has the largest number of resin spheres mixed (that has the highest degree of density of resin spheres in the resin), and then uncured resin that does not include hollow resin spheres is poured and cured, whereby the air bubbles 8 are located as illustrated in FIG. 5. As described above, the use of previously fabricated hollow resin spheres facilitates the provision of air bubbles that have a desired shape and size at desired locations.

Another possible method to be used is that uncured resin is poured into the inside of the frame member 5*a*, gas is injected into a desired area in the resin so that the air bubble 8 is formed, and then the resin is cured. For example, the end of a narrow tube is brought into contact with the surface boundary between the frame member 5*a* and the resin, the end of the tube is moved along the surface boundary between the frame member 5*a* and the resin while gas is intermittently injected through the tube so that the air bubbles 8 are formed, and then the resin is cured, whereby, as illustrated in FIG. 2, the air bubbles 8 can be provided so as to abut the boundary between the frame member 5*a* and the resin layer 20. In the same manner, the end of the tube is brought into contact with the surface boundary between the piezoelectric element 1 and the resin, the end of the tube is moved along the surface boundary between the piezoelectric element 1 and the resin while gas is intermittently injected through the tube so that the air bubbles 8 are formed, and then the resin is cured, whereby, as illustrated in FIG. 3, the air bubbles 8 can be provided so as to abut the boundary between the piezoelectric element 1 and the resin layer 20. Furthermore, in the same manner, the end of the tube is brought into contact with the surface boundary between the film 3 and the resin, the end of the tube is moved along the surface boundary between the film 3 and the resin while gas is intermittently injected through the tube so that the air bubbles 8 are formed, and then the resin is cured, whereby, as illustrated in FIG. 4, the air bubbles 8 can be provided so as to abut the boundary between the film 3 and the resin layer 20.

As illustrated in FIGS. 2 to 5, the air bubbles 8 can be provided at desired locations in the resin layer 20 by means of the above-described methods, for example. A method of providing the air bubbles 8 in the resin layer 20 is not limited to the above-described methods, and other methods may be used.

Furthermore, FIG. 1B illustrates a case where the bimorph piezoelectric element 1 is installed on one of the principal surfaces of the film 3; however, this is not a limitation. The same advantage can be produced by using, instead of the bimorph piezoelectric element, for example, a unimorph piezoelectric element that is configured by attaching a plate of metal, or the like, to one of the principal surfaces of the piezoelectric element that expands and contracts for vibration in a planar direction. Moreover, a piezoelectric element that expands and contracts for vibration in a planar direction may be installed on both surfaces of the film 3, or a unimorph or bimorph piezoelectric element may be installed on both surfaces of the film 3.

Furthermore, FIG. 1B illustrates a case where the resin layer 20 is provided so as to completely cover the piezoelectric element 1 inside the frame member 5*a*; however, this is not a limitation. For example, the resin layer 20 may be provided over the film 3 only without completely covering the piezoelectric element 1.

Furthermore, FIG. 1A illustrates a case where the shape of the inner area of the frame member 5 is substantially rectangular; however, this is not a limitation. For example, the shape of the inner area of the frame member 5 may be oval.

(2) Second Configuration

Figure 6:
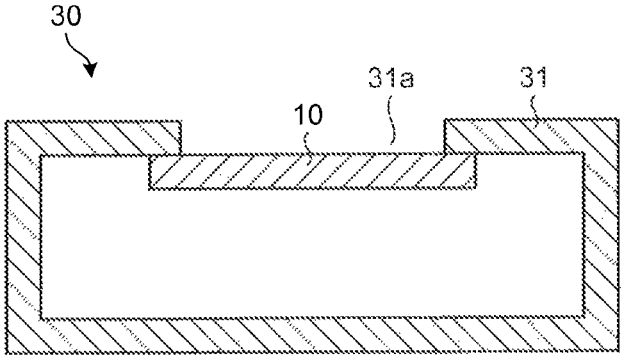
FIG. 6 is a cross-sectional view that schematically illustrates an acoustic generation device according to a second configuration.

Next, an explanation is given, with reference to FIG. 6, of an acoustic generation device according to a second configuration of the present invention. FIG. 6 is a diagram that illustrates a configuration of an acoustic generation device 30 according to the second configuration of the present invention. FIG. 6 illustrates only the components that are necessary for explanations, and the description on the detailed configuration or typical components of an acoustic generator 10 are omitted.

The acoustic generation device 30 is a sound generator, what is called a speaker, and, as illustrated in FIG. 6, includes, for example, a chassis 31 and the acoustic generator 10 that is secured to the chassis 31. The chassis 31 has a cuboidal shape like a box, and an opening 31*a* is formed on one of the surfaces. The above-described chassis 31 may be formed by using a known material, such as plastic, metal, or wood. Furthermore, the shape of the chassis 31 is not limited to a cuboidal shape like a box and may be various shapes, such as cylinder or frustum.

Furthermore, the acoustic generator 10 is attached to the opening 31*a* of the chassis 31. The acoustic generator 10 is the above-described acoustic generator according to the first configuration, and the explanation of the acoustic generator 10 is omitted. The acoustic generation device 30 that has the above-described configuration is capable of generating high-quality sounds as it generates sounds by using the acoustic generator 10 that generates high-quality sounds. Moreover, as the acoustic generation device 30 is capable of producing a resonance of sound generated by the acoustic generator 10 inside the chassis 31, it is possible to increase the sound pressure in a low frequency range, for example. The area where the acoustic generator 10 is installed may be set in a flexible manner. Moreover, the acoustic generator 10 may be secured to the chassis 31 via another member.

(3) Third Configuration

Figure 7:
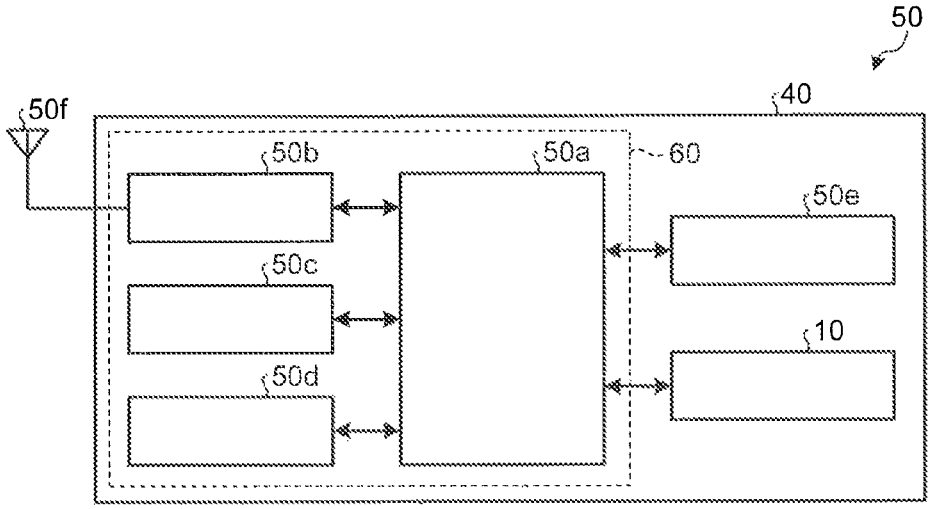
FIG. 7 is a diagram that schematically illustrates an electronic device according to a third configuration.

Next, an explanation is given, with reference to FIG. 7, of an electronic device according to a third configuration of the present invention. FIG. 7 is a diagram that illustrates a configuration of an electronic device 50 according to the third configuration of the present invention. FIG. 7 illustrates only the components that are necessary for explanations, and the description on the detailed configuration or typical components of the acoustic generator 10 are omitted.

FIG. 7 illustrates a case where the electronic device 50 is a mobile terminal device, such as a mobile phone or tablet terminal. As illustrated in FIG. 7, the electronic device 50 includes a chassis 40, the acoustic generator 10 that is secured to the chassis 40, and an electronic circuit 60 that is connected to the acoustic generator 10. The acoustic generator 10 is the above-described acoustic generator according to the first configuration, and the explanation of the acoustic generator 10 is omitted. The electronic circuit 60 includes, for example, a controller 50*a*, a transmitting and receiving unit 50*b*, a key input unit 50*c*, and a microphone input unit 50*d*. The electronic circuit 60 is connected to the acoustic generator 10, and it has a function to output sound signals to the acoustic generator. The acoustic generator 10 generates sounds in accordance with a sound signal input from the electronic circuit 60.

The electronic device 50 further includes a display unit 50*e* and an antenna 50*f*, and each of the devices is attached to the chassis 40. FIG. 7 illustrates a state where the single chassis 40 accommodates each of the devices, including the controller 50*a*; however, this is not a limitation on the accommodation form of each of the devices. According to the present embodiment, if at least the acoustic generator 10 is attached to the chassis 40 directly or via another member, the placement of the other components may be set in a flexible manner.

The controller 50*a* is a control unit of the electronic device 50. The transmitting and receiving unit 50*b* transmits and receives data via the antenna 50*f* under the control of the controller 50*a*. The key input unit 50*c* is an input device of the electronic device 50 to receive a key input operation from an operator. The microphone input unit 50*d* is also an input device of the electronic device 50 to receive a sound input operation, or the like, from an operator. The display unit 50*e* is a display output device of the electronic device 50 to output display information under the control of the controller 50*a*. The acoustic generator 10 operates as an acoustic output device of the electronic device 50. The acoustic generator 10 is connected to the controller 50*a* of the electronic circuit 60 and generates sounds when it receives application of the voltage that is controlled by the controller 50*a*.

The electronic device 50 that has the above-described configuration is capable of generating high-quality sounds as it generates sounds by using the acoustic generator 10 that generates high-quality sounds.

With reference to FIG. 7, an explanation is given of a case where the electronic device 50 is a mobile terminal device, such as smartphone, mobile phone, PHS (Personal Handyphone System), or PDA (Personal Digital Assistants); however, this is not a limitation, and it may be various electronic devices that have a function to generate sounds. It may be various products that have a function to generate sounds or voices, for example, cleaners, washing machines, refrigerators, or microwave ovens, as well as televisions, personal computers, or car audio equipment.

EXAMPLE

In the present example, an explanation is given of the difference in the frequency characteristics of sound pressure between the resin layer 20 that does not include the air bubbles 8 and the resin layer 20 that includes the air bubbles 8 and also the difference in the frequency characteristics of sound pressure depending on the concentration of the air bubbles 8 included in the resin layer 20.

Figure 8:
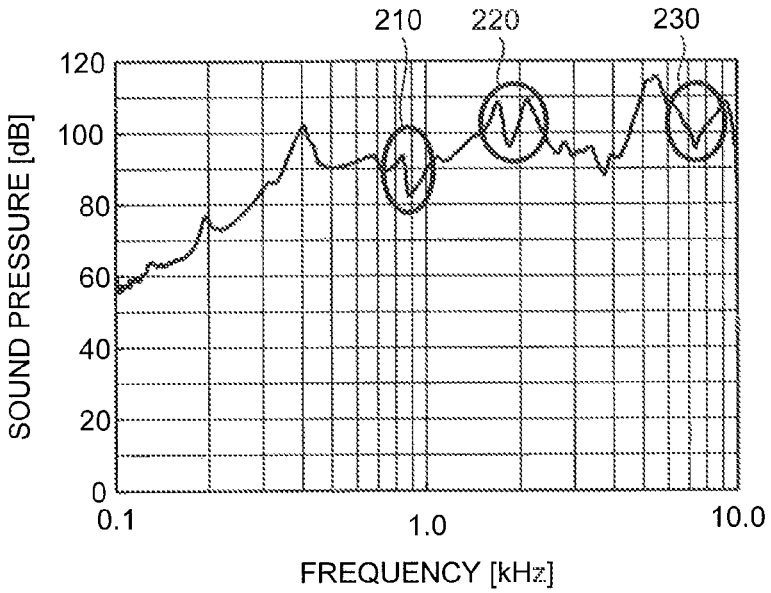
FIG. 8 is a graph that illustrates an example of the frequency characteristics of sound pressure.
Figure 9:
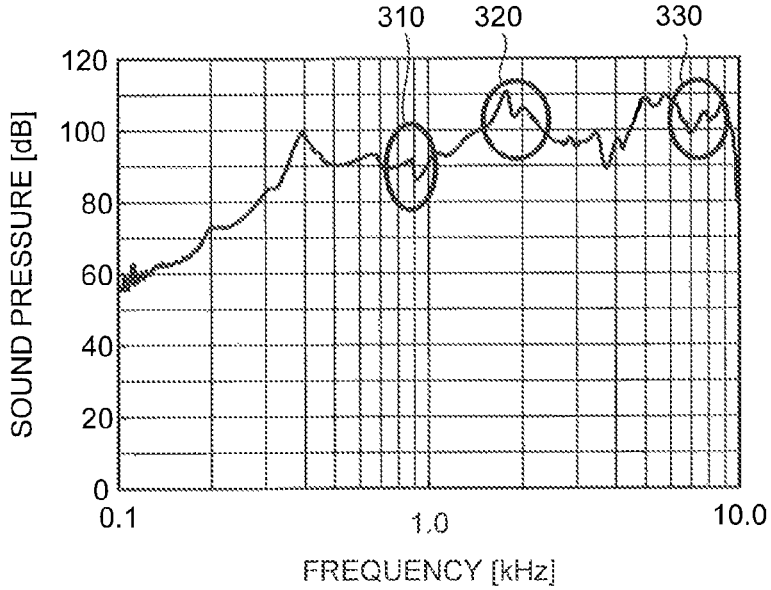
FIG. 9 is a graph that illustrates an example of the frequency characteristics of sound pressure.
Figure 10:
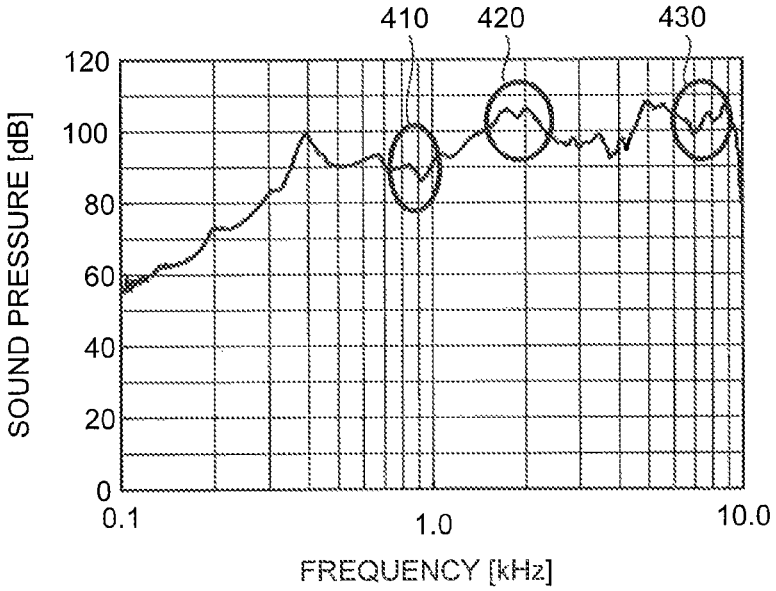
FIG. 10 is a graph that illustrates an example of the frequency characteristics of sound pressure.
Figure 11:
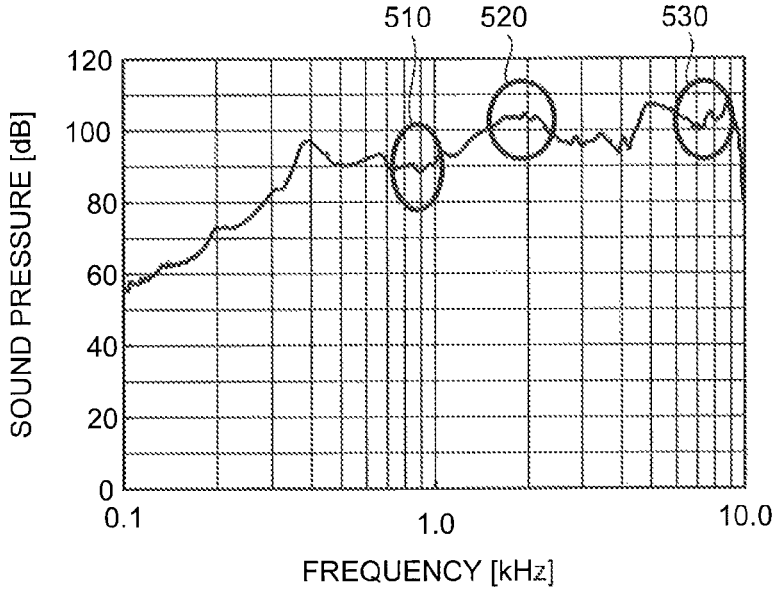
FIG. 11 is a graph that illustrates an example of the frequency characteristics of sound pressure.

FIGS. 8 to 11 are graphs that illustrate examples of the frequency characteristics of sound pressure. FIG. 8 illustrates the frequency characteristics of sound pressure in a case where the percentage of the volume of the air bubbles 8 in the volume of the overall resin layer 20 is 0%, i.e., a case where the resin layer 20 does not include the air bubbles 8. Furthermore, FIG. 9 illustrates the frequency characteristics of sound pressure in a case where the percentage of the volume of the air bubbles 8 in the volume of the overall resin layer 20 is 10%. FIG. 10 illustrates the frequency characteristics of sound pressure in a case where the percentage of the volume of the air bubbles 8 in the volume of the overall resin layer 20 is 20%. FIG. 11 illustrates the frequency characteristics of sound pressure in a case where the percentage of the volume of the air bubbles 8 in the volume of the overall resin layer 20 is 30%. The vertical axis of the graphs illustrated in FIGS. 8 to 11 represents the sound pressure, and the horizontal axis of the graphs represents the frequency. In the acoustic generators for which the sound pressure frequency characteristics are measured as illustrated in FIGS. 8 to 11, the configuration except for the concentration of the air bubbles 8, i.e., each member and the size and the material of the member are set to be identical.

First, in order to explain the difference in the frequency characteristics of sound pressure based on the presence or absence of the air bubbles 8, the graph illustrated in FIG. 8 is compared with the graph illustrated in FIG. 9. When the peaks and dips that are located in a frequency range 210 of 700 Hz to 1 kHz, a frequency range 220 of 1.5 kHz to 2.5 kHz, and a frequency range 230 of 6 kHz to 9 kHz, which are in FIG. 8, are compared with the peaks and dips that are located in a frequency range 310 of 700 Hz to 1 kHz, a frequency range 320 of 1.5 kHz to 2.5 kHz, and a frequency range 330 of 6 kHz to 9 kHz, which are illustrated in FIG. 9, it is evident that the peaks and dips in the graph of FIG. 9 are smaller than the peaks and dips in the graph illustrated in FIG. 8. Furthermore, with regard to the peak that is located in the vicinity of 0.4 kHz or the peak that is located in the vicinity of 5 kHz to 6 kHz, it seems that the level thereof is lowered.

As described above, it is determined that, if the volume concentration of the air bubbles 8 included in the resin layer 20 is 10%, the peaks and dips in most of the frequency ranges become smaller, the flatness is increased, and thus the frequency characteristics of sound pressure is improved, compared to a case where the air bubbles 8 are not included.

Furthermore, a comparison is made between a case where the volume concentration of the air bubbles 8 included is 10% and a case where the volume concentration of the air bubbles 8 included is 20%. When the peaks and dips that are located in the frequency range 310 of 700 Hz to 1 kHz and the frequency range 320 of 1.5 kHz to 2.5 kHz, which are illustrated in FIG. 9, are compared with the peaks and dips that are located in a frequency range 410 of 700 Hz to 1 kHz and a frequency range 420 of 1.5 kHz to 2.5 kHz, which are illustrated in FIG. 10, it is evident that the peaks and dips in the graph of FIG. 10 are smaller than the peaks and dips in the graph illustrated in FIG. 9.

As described above, it is determined that, if the volume concentration of the air bubbles 8 included in the resin layer 20 is 20%, the peaks and dips become smaller, the flatness is increased, and thus the frequency characteristics of sound pressure is improved, compared to a case where the volume concentration of the air bubbles 8 included is 10%.

Moreover, a comparison is made between a case where the volume concentration of the air bubbles 8 included is 20% and a case where the volume concentration of the air bubbles 8 included is 30%. When the peaks and dips that are located in the frequency range 410 of 700 Hz to 1 kHz and the frequency range 420 of 1.5 kHz to 2.5 kHz, which are illustrated in FIG. 10, are compared with the peaks and dips that are located in a frequency range 510 of 700 Hz to 1 kHz and a frequency range 520 of 1.5 kHz to 2.5 kHz, which are illustrated in FIG. 11, it is evident that the peaks and dips in the graph of FIG. 11 are smaller than the peaks and dips in the graph illustrated in FIG. 10.

As described above, it is determined that, if the volume concentration of the air bubbles 8 included in the resin layer 20 is 30%, the peaks and dips become smaller, the flatness is increased, and thus the frequency characteristics of sound pressure is improved, compared to a case where the volume concentration of the air bubbles 8 included is 20%.

According to the above-described results, it is determined that variations of the sound pressure in the sound pressure frequency characteristics can be reduced in a case where the air bubbles 8 are included in the resin layer 20 compared to a case where the air bubbles 8 are not included in the resin layer 20, and the frequency characteristics of sound pressure can be improved in a case where a larger number of the air bubbles 8 are included. Thus, the usefulness of the present invention has been confirmed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An acoustic generator comprising:

a film;

a frame that is provided on a periphery of the film;

a piezoelectric element that is distinct from and adjacent to the film and is provided inside the frame; and a resin layer that is provided on the film and is provided inside the frame, the resin layer including a plurality of air bubbles, wherein the plurality of air bubbles comprises a plurality of first air bubbles which is abutting an area where stiffness changes, the plurality of first air bubbles includes at least one of second and third air bubbles, the second air bubbles are provided to abut a boundary between the piezoelectric element and the resin layer, each of the second air bubbles has a shape that elongates in a direction along the boundary between the piezoelectric element and the resin layer, and the third air bubbles are provided to abut a boundary between the frame and the resin layer, each of the third air bubbles has a shape that elongates in a direction along the boundary between the frame and the resin layer.

2. The acoustic generator according to claim 1, wherein the plurality of first air bubbles further includes fourth air bubbles which are abutting a boundary between the film and the resin layer.

3. The acoustic generator according to claim 1, wherein a number of the air bubbles is increased as the air bubbles are located closer to a surface boundary between the film and the resin layer.

4. An acoustic generation device comprising:

a housing; and the acoustic generator according to claim 1 that is installed in the housing.

5. An electronic device comprising:

a case;

the acoustic generator according to claim 1 that is installed in the case; and an electronic circuit that is connected to the acoustic generator, wherein the electronic device has a function to generate a sound from the acoustic generator.

6. The acoustic generator according to claim 1, wherein the plurality of air bubbles further comprises a plurality of fifth air bubbles which is not abutting the area.

* * * * *